US008764281B2

(12) United States Patent
Zaugg

(10) Patent No.: US 8,764,281 B2
(45) Date of Patent: Jul. 1, 2014

(54) ANTI-TRIP BALANCE-SPRING FOR A TIMEPIECE ESCAPEMENT

(75) Inventor: Alain Zaugg, Le Sentier (CH)

(73) Assignee: Montres Breguet SA, L'Abbaye (CH)

( * ) Notice: Subject to any disclaimer, the term of this patent is extended or adjusted under 35 U.S.C. 154(b) by 450 days.

(21) Appl. No.: 13/246,148

(22) Filed: Sep. 27, 2011

(65) Prior Publication Data

US 2012/0075963 A1 Mar. 29, 2012

(30) Foreign Application Priority Data

Sep. 28, 2010 (EP) ..... 10181111

(51) Int. Cl.
*G04B 17/06* (2006.01)

(52) U.S. Cl.
USPC ..... 368/175

(58) Field of Classification Search
CPC ..... G04B 17/06; G04B 17/066; G04B 18/026
USPC ..... 368/175–178; 29/896.3–896.34; 267/166
See application file for complete search history.

(56) References Cited

U.S. PATENT DOCUMENTS 3,696,687 A * 10/1972 Harland ..... 74/431
2006/0072376 A1 4/2006 Gabus et al.

FOREIGN PATENT DOCUMENTS

EP 1 431 844 A1 6/2004
EP 1 645 918 A1 4/2006

OTHER PUBLICATIONS

European Search Report issued Mar. 10, 2011, in French 10 18 1111, filed Sep. 28, 2010 (with English Translation of Category of Cited Documents).
Charles-André Reymondin, et al., "Theory of Horology", Chapter 6.7 Some other types of escapements, 6.7.1 Detent escapement, Sep. 1999, 1 page.

* cited by examiner

*Primary Examiner* — Amy Cohen Johnson
*Assistant Examiner* — Jason Collins
(74) *Attorney, Agent, or Firm* — Oblon, Spivak, McClelland, Maier & Neustadt, L.L.P.

(57) ABSTRACT

The anti-trip balance-spring for a timepiece escapement which has no stop member is intended to oscillate between two extreme positions, passing through a position of equilibrium. It includes a plurality of coils and further includes means for locking at least two consecutive coils when the amplitude of rotation from the position of equilibrium to at least one of the end positions, reaches a determined angle Ψ.

13 Claims, 6 Drawing Sheets

ANTI-TRIP BALANCE-SPRING FOR A TIMEPIECE ESCAPEMENT

Figure 2:
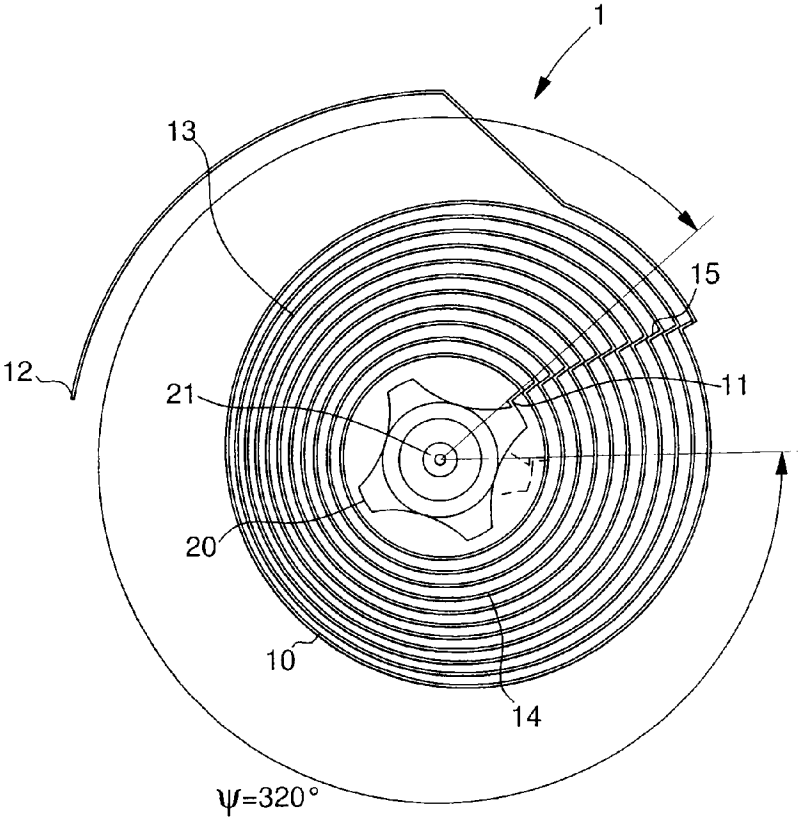

This application claims priority from European Patent Application No. 10181111.5 filed 28 Sep. 2010, the entire disclosure of which is incorporated herein by reference.

The present invention relates to an anti-trip balance-spring for a detent type timepiece escapement which has no stop member.

The phenomenon of tripping is well known to those skilled in the art. It essentially concerns detent escapements, and when it occurs, greatly impairs the precision of the timepiece to which the escapement is fitted.

Detent escapements are notably used in precision timepieces, since they disturb the isochronism of the oscillator less than Swiss lever escapements. For a detailed description of this type of escapement, reference may be made to chapter 6.7.1 of the work entitled "Théorie de l'horlogerie" (*Theory of Horology*). We will merely mention here the principle of tripping to which it is subject.

In a detent escapement, the sprung balance oscillator oscillates between two extreme positions, a "high" position and a "low" position. Each of the oscillations includes a "rising" vibration, during which it changes from the low position to the high position, and a "falling" vibration during which it changes from the high position to the low position. The escape wheel delivers one impulse per oscillation to the sprung-balance oscillator in the rising vibration, in an "equilibrium" position, approximately half way between the high position and the low position. In the falling vibration, the sprung balance does not receive any impulses. It should be noted that it is unimportant whether the rising and falling vibrations are associated with the contraction or radial extension of the balance-spring.

The amplitude of each vibration, namely the angular displacement of the oscillator from the position of equilibrium to the high or low position, is typically 330°. In the event of a shock, the sprung balance may receive an excessive amount of energy causing the amplitude to exceed this value, and even exceed 360°, the limit value beyond which the sprung balance receives an additional impulse. The rising vibration may then count two impulses, whereas the falling vibration may count one. The escape wheel, which normally makes one step per oscillation, then makes two or even three steps during the same oscillation. This racing of the sprung balance, which is self-maintained, is called "tripping". It impairs the precision of the movement, since each additional step taken by the escape wheel makes the time measurement fast by a duration that is inversely proportional to the oscillation frequency of the sprung balance.

Various locking mechanisms exist to prevent the sprung balance from tripping. The object of these mechanisms is to lock the rotational movement of the sprung balance beyond a determined angle of around 330°. One of these mechanisms, disclosed in EP Patent No. 1 801 669, includes a pinion rotating integrally with the sprung balance. Said pinion meshes with a pivotably mounted, toothed sector, fitted with two end spokes able to abut against a fixed stop if the balance is driven beyond a determined angle of rotation. This device is efficient in preventing the oscillator from racing, in both directions of rotation. However, it generates losses in the gear between the pinion and the toothed sector, which disturb the isochronism of the sprung balance. Another mechanism, disclosed in EP Patent Application No. 1 645 918, includes an arm, mounted radially on the last coil of the balance-spring, which is inserted between a finger integral with the balance and two columns mounted on a balance bridge, when the sprung balance exceeds a certain angular and radial extension. This device is difficult to implement, essentially because of the extreme precision required for the assembly thereof.

The present invention proposes a simple and robust alternative to existing anti-trip devices. It concerns more specifically an anti-trip balance-spring for a timepiece escapement, intended to oscillate between two extreme positions, passing through a position of equilibrium and including a plurality of coils. According to the invention, it also includes means for locking at least two consecutive coils when the amplitude of rotation from the point of equilibrium to at least one of the end positions, reaches a determined angle Ψ.

In an advantageous embodiment, this means includes transverse segments integral with consecutive coils, angularly shifted to abut against each other when the amplitude of rotation of the balance-spring according to the invention reaches a determined angle Ψ, from said point of equilibrium to at least one of the end positions thereof.

Owing to these transverse segments, the balance-spring is braked or locked in rotation without the use of any external means which may disturb isochronism.

The present invention also concerns a timepiece escapement fitted with an anti-trip balance-spring of this type.

Figure 1:
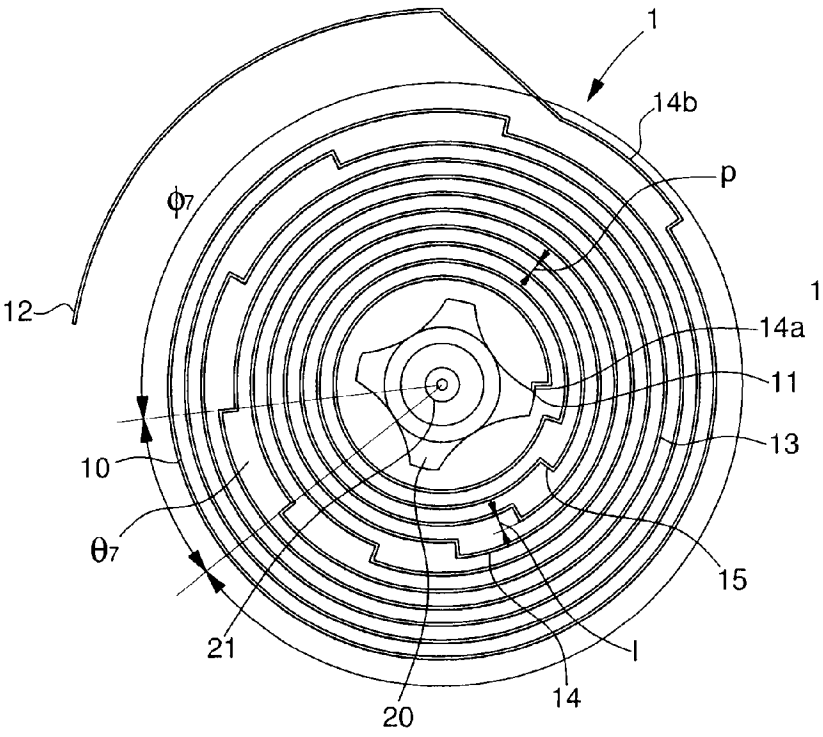
Figure 3:
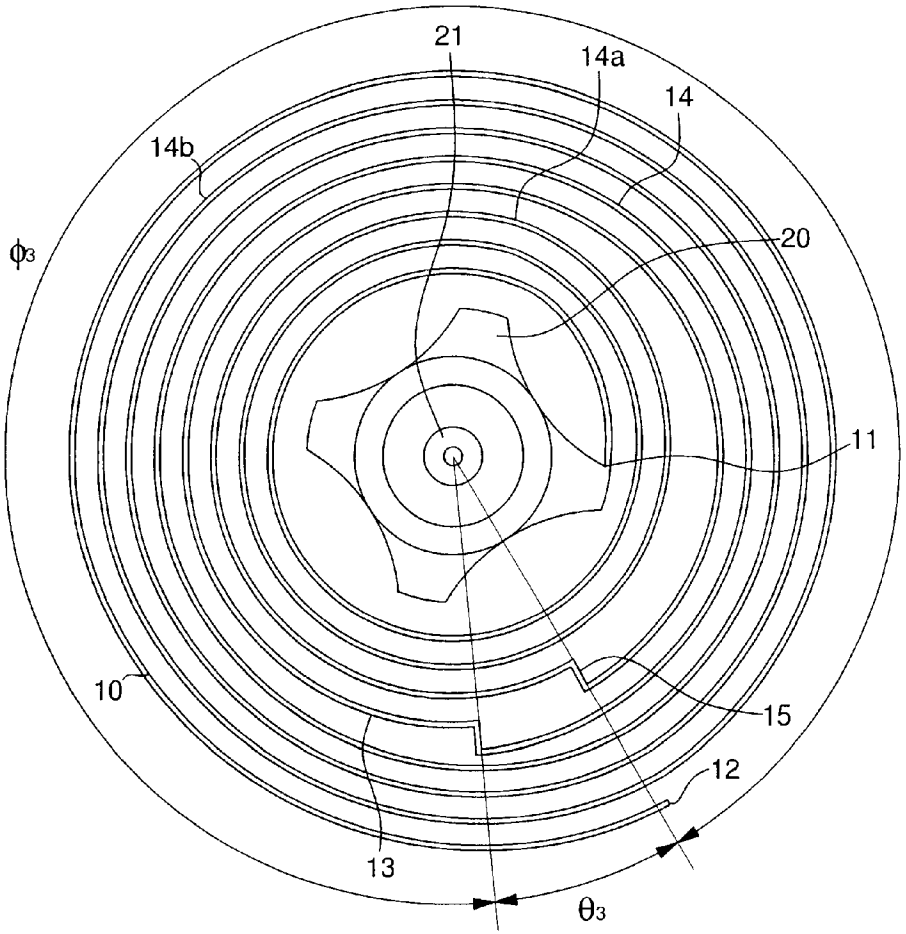
Figure 5:
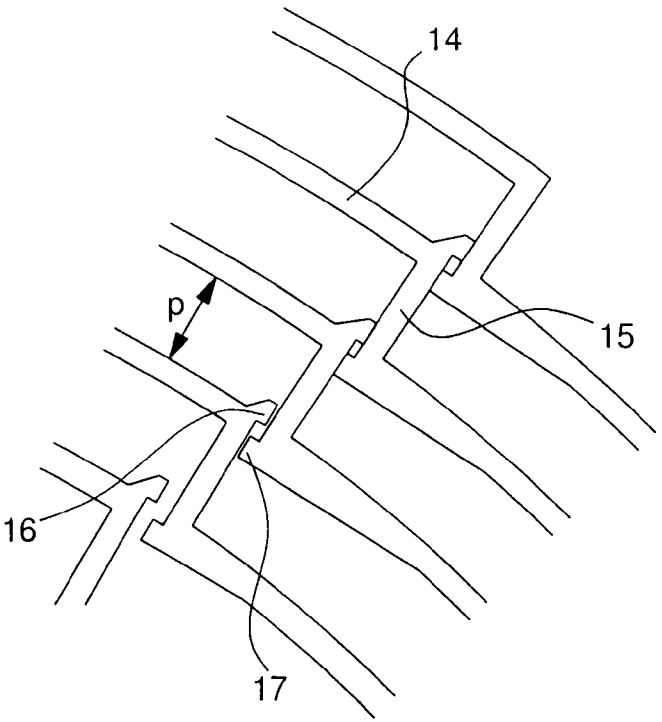
Figure 4:
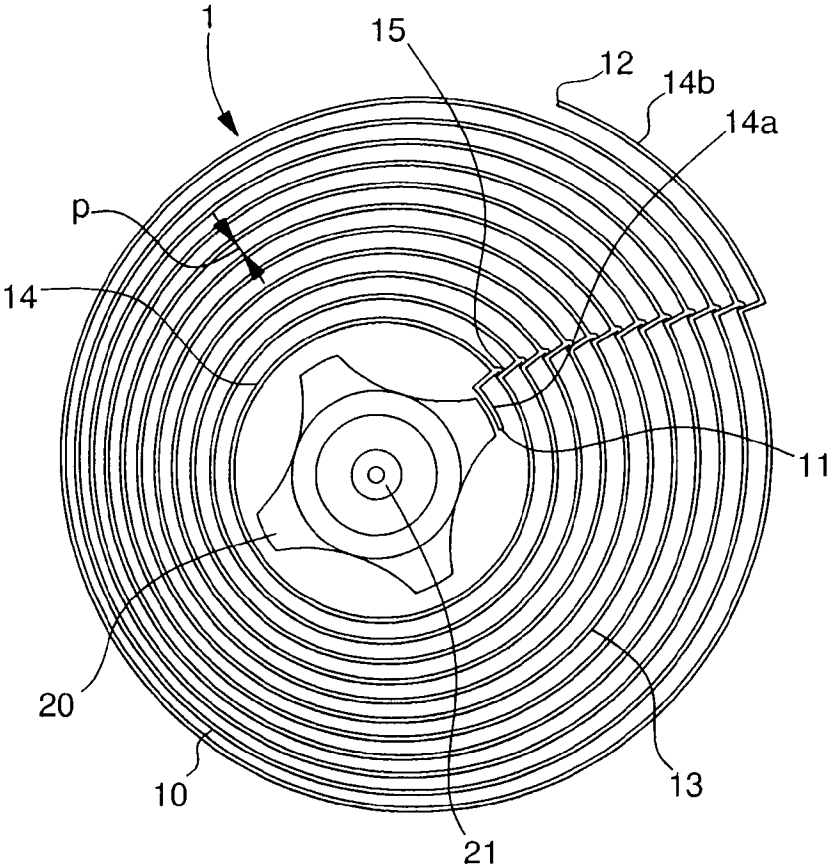
Figure 7:
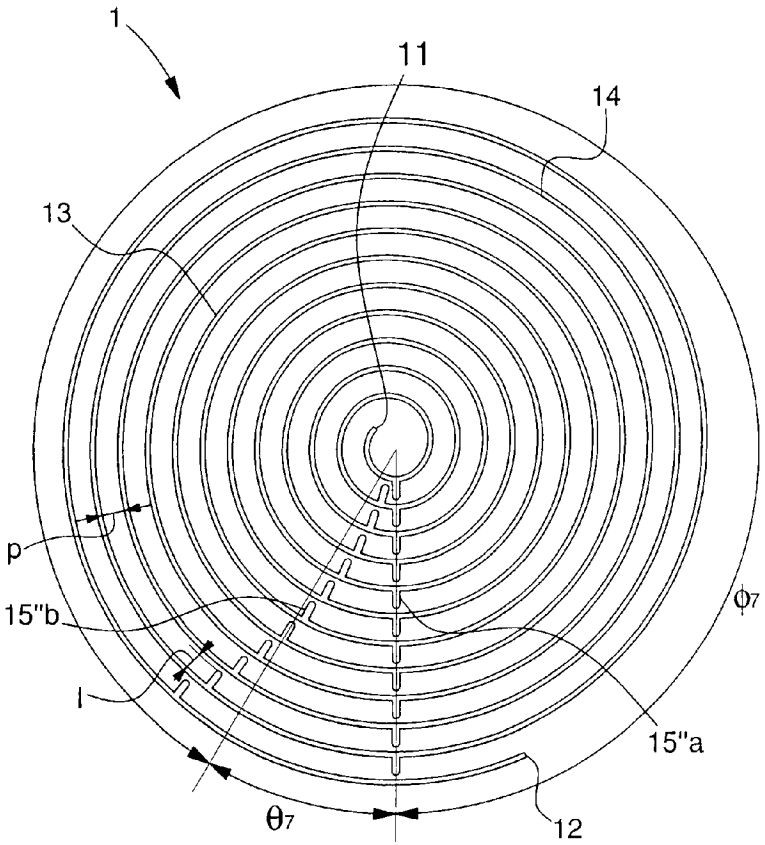
Figure 6:
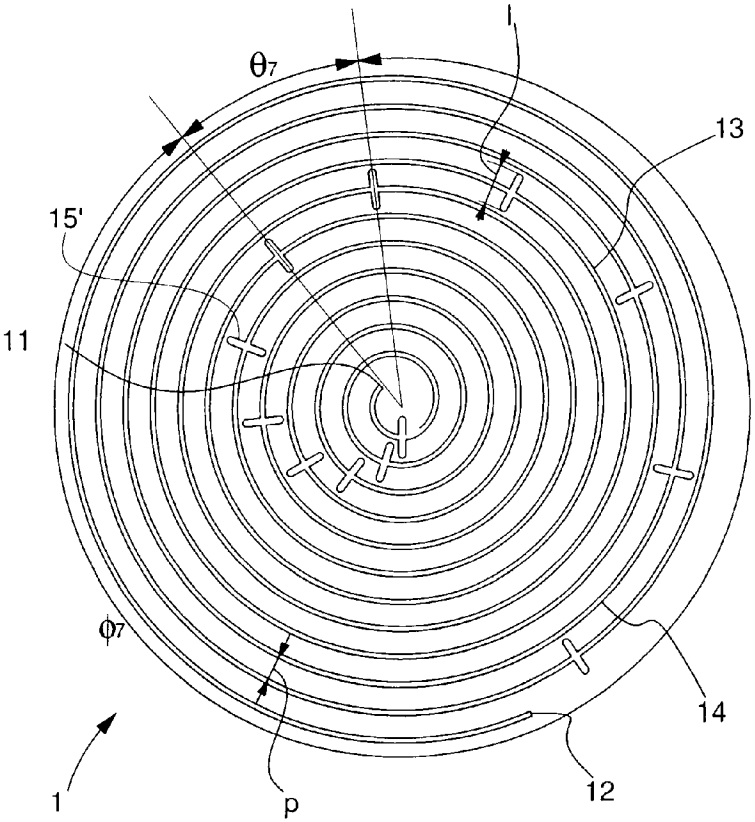

Other features and advantages of the present invention will appear from the following description, given with reference to the annexed drawings, and providing, by way of explanatory but non-limiting illustration, several advantageous embodiments of an anti-trip balance-spring for a timepiece. In the drawings:

FIGS. 1 and 2 are top views of a first embodiment of an anti-trip balance-spring according to the invention, respectively in the position of equilibrium and in a locking position, FIG. 3 illustrates a variant of the first embodiment of this type of balance-spring, FIG. 4 shows an advantageous variant of the first embodiment of an anti-trip balance-spring according to the invention, in a locking position, FIG. 5 is a view of a detail of the balance-spring shown in FIG. 4;

FIGS. 6 and 7 are top views of second and third embodiments of an anti-trip balance-spring according to the invention, configured to form a lock during contraction.

Figure 9:
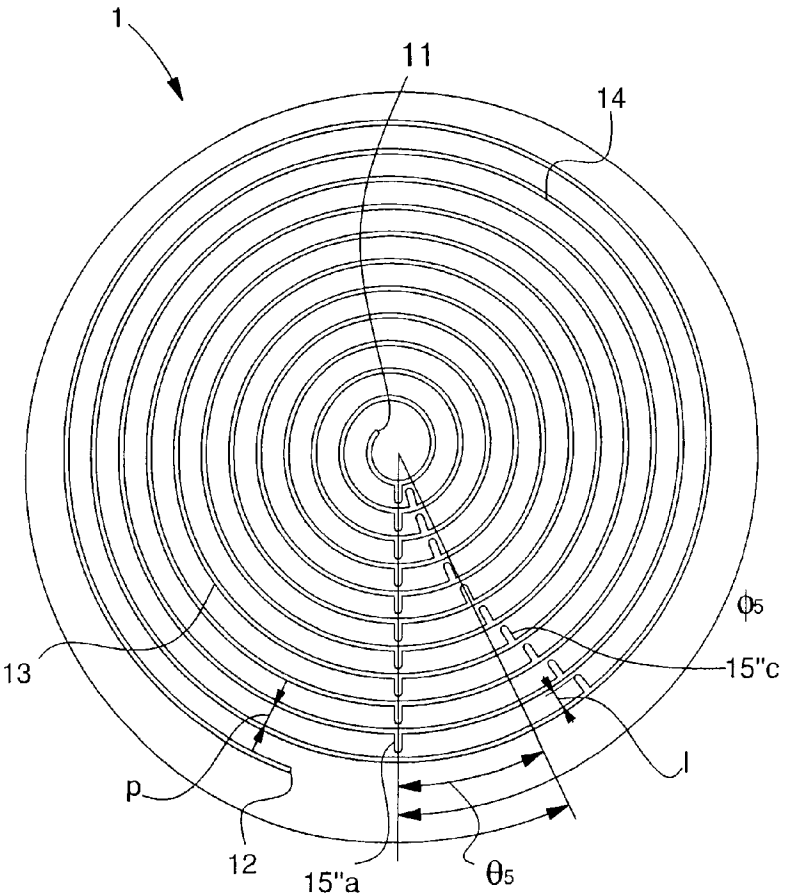
Figure 8:
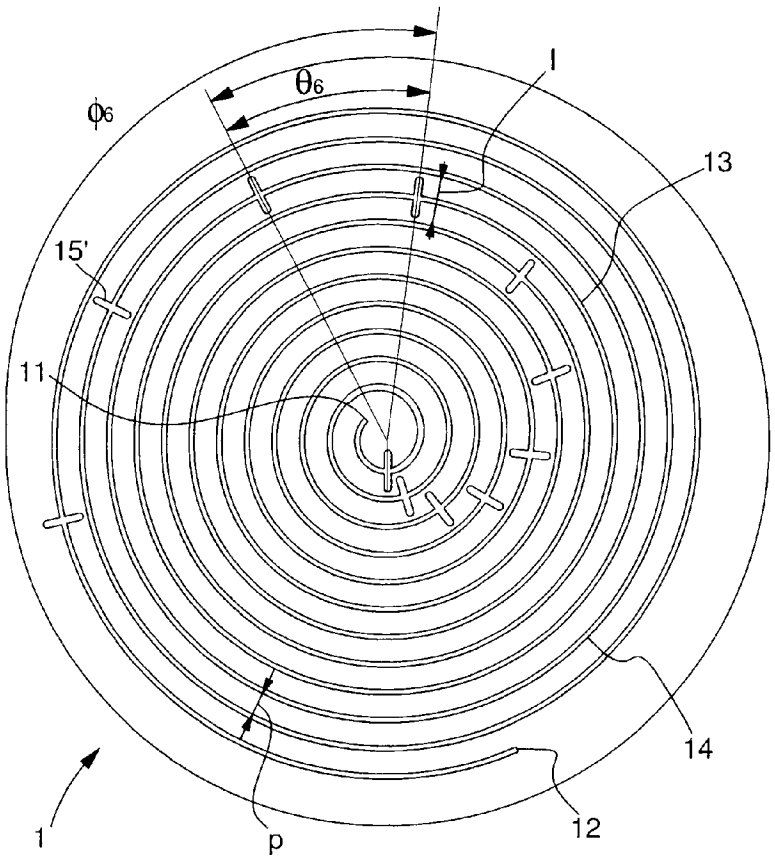
Figure 10:
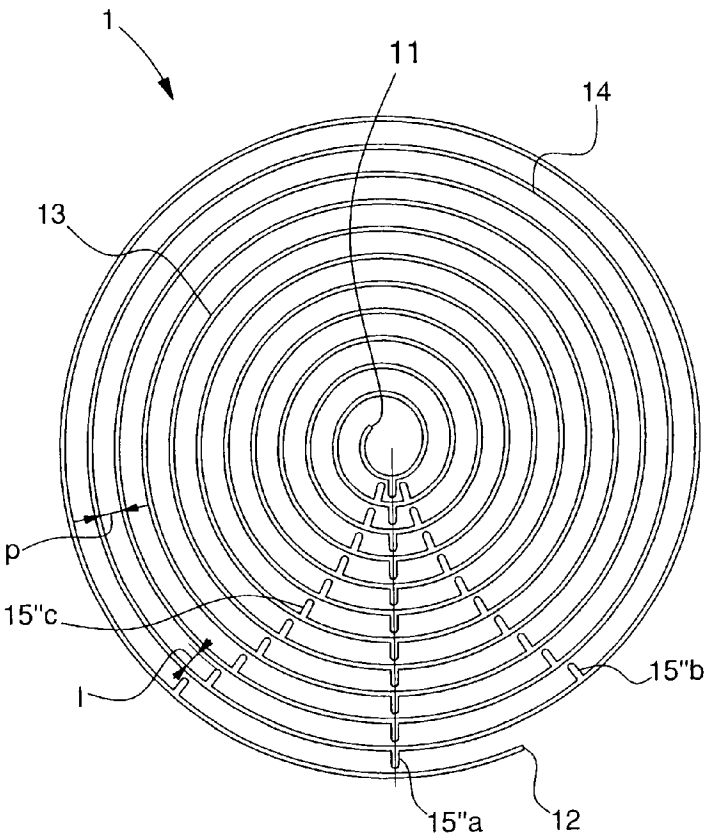

FIGS. 8 and 9 illustrate the same second and third embodiments of the anti-trip balance-spring according to the invention, this time configured to form a lock during extension, and FIG. 10 shows an anti-trip balance-spring according to the invention, combining the features of embodiments 7 and 9.

The anti-trip balance-spring shown in the position of equilibrium in FIGS. 1, 3, 6, 7, 8, 9 and 10 with the general reference 1, is generally formed by a strip 10 wound in a spiral on itself, so as to have angular elasticity. The central end 11 of strip 10 is pinned up in a known manner to a collet 20 driven onto a balance staff 21, while the peripheral end 12 thereof is intended to be secured to a balance cock, which is not shown. From one end to the other, balance-spring 1 includes a plurality of coils 13, typically between 10 and 15, having a pitch p between them at equilibrium.

According to the invention, balance-spring 1 further includes a plurality of transverse, segments 15, 15', 15"*a*, 15"*b*, 15"*c* integral with successive coils 13 and angularly arranged to abut on each other, when the amplitude of rotation of balance-spring 1 exceeds a determined angle Ψ, comprised between 300° and 360°, from the position of equilibrium to one of the end positions thereof.

In the embodiment shown in FIGS. 1 to 5, balance-spring 1 is formed, from the central end 11, of a first spiral portion 14*a* for connection to collet 20, then a succession of spiral portions 14 of pitch p, connected to each other by transverse segments 15 of length l and finally, a last spiral portion 14*b* for connection to a balance cock. Preferably, segments 15 extend radially, but in a variant, they may be slightly inclined relative to the radial orientation. By design, the initial radius of a spiral portion 14 is equal to the final radius of a preceding portion 14 increased by the length l of one segment 15. Successive transverse segments 15 are arranged angularly to abut against each other when the amplitude of the vibration associated with the balance-spring 1 contraction reaches a determined value Ψ comprised between 300° and 360°.

For this purpose, the various parameters of balance-spring 1, in the position of equilibrium thereof, are linked by geometrical relationships which are explained below. The number of coils 13 of balance-spring 1 from the central end 11 to the peripheral end 12 is referenced N, the radius of the nth coil 13 is referenced $R_n$, and the radii respectively of the first and last coil 13 are referenced $R_1$ and $R_N$. The angular shift from the equilibrium position, relative to the radially aligned position, between the transverse segments 15 respectively associated with the nth and n+1th coils 13 is referenced $\theta_n$, and the angular sector of the nth spiral portion 14 is referenced $\Phi_n$.

It is known that the amplitude of rotation of balance-spring 1, from its position of equilibrium to one of the end positions is not uniformly distributed over all of the N coils 13, the large radius coils 13 absorbing a larger part of the amplitude of rotation than the small radius coils 13. It can be demonstrated that for a given amplitude of rotation of balance-spring 1, each coil 13 deforms by an angle proportional to the radius $R_n$ thereof. It follows that the radial segments 15 associated respectively with the nth and n+1th coils, are radially aligned when the amplitude associated with the contraction of balance-spring 1 takes the determined value Ψ, if the angular shift $\theta_n$ between them at the position of equilibrium obeys the relation:

$$\theta_n = \frac{\psi}{N} \cdot \frac{R_n}{R_N - R_1}$$

The angular sector Φn of an nth spiral portion 14 is the complement of the angular shift $\theta_n$ between the radial segments 15 respectively associated with the nth and n+1th coils 13. It thus obeys the following relation:

$$\phi_n = 360 - \frac{\psi}{N} \cdot \frac{R_n}{R_N - R_1}$$

For example, for a number of coils equal to 10, as illustrated in FIGS. 1 and 2, and an angle Ψ of 320°, there are 11 spiral portions 14 and 12 radial segments 15. The angular shifts $\theta_n$ between radial segments vary from 16° from the central end 11, to 41° at the peripheral end 12, while the angular sectors $\Phi_n$ of spiral portions 14 vary from 344° to 319°.

Finally, in order for two consecutive segments 15 to abut against each other when the vibration amplitude reaches the determined value, their length l must be sufficient. As those skilled in the art know, the pitch p of a balance-spring 1 decreases, when it contracts, by a value dependent upon the vibration amplitude and the number N of coils 13. Therefore, segments 15 contact each other if length l of segments 15 obeys the relation:

$$2p > l \geq p$$

When the preceding rules of construction are applied, transverse segments 15 abut against each other beyond a determined rotation angle LP in contraction, as shown in FIG. 2. Coils 13 are thus locked in rotation relative to each other and balance-spring 1 has no more, or virtually no more, angular elasticity. The movement of rotation of said balance-spring is abruptly locked. Tripping is thus prevented in the vibration associated with the contraction of balance-spring 1. This vibration will preferably be the rising vibration, since tripping occurs more frequently during that vibration.

It is to be noted here that it may be sufficient to brake rather than lock the rotation of balance-spring 1 in the event of a shock. In such case, balance-spring 1 is formed, at a minimum, of a first spiral portion 14*a* of any angular sector, a second spiral portion 14 of angular sector $$\phi_n = 360 - \frac{\psi}{N} \cdot \frac{R_n}{R_N - R_1},$$

and a third spiral portion 14*b*, of any angular sector. The three spiral portions 14 are connected to each other by two transverse segments 15, abutting against each other when the determined angle Ψ is reached. In this case, only two consecutive coils are locked in rotation relative to each other, thereby braking, instead of locking, the general movement of rotation of balance-spring 1. This variant of the first embodiment is illustrated in FIG. 3. By extension, balance-spring 1 may include two, three and up to N' spiral portions 14, and respectively three, four and up to N'+1 transverse segments 15, where N' is a function of the number N of coils 13 and angle Ψ. The braking of balance-spring 1 increases with the number of spiral portions 14 and transverse segments 15 until total locking of the balance-spring when the number of spiral portions 14 takes the maximum value N'.

Reference will now be made to FIGS. 4 and 5 which show an advantageous embodiment of the balance-spring 1 illustrated in FIGS. 1 and 2. According to this variant, segments 15 extend radially slightly beyond the two spiral portions 14 which they connect, and include two fingers 16 and 17 at the ends thereof, extending angularly towards the exterior of the spiral portions 14 which said segments connect. As shown in detail in FIG. 5, fingers 16 and 17 fit into each other when segments 15 are abutting. Segments 15 are then radially locked in relation to each other, which, in addition to angular rigidity, gives balance-spring 1 radial rigidity, when the determined amplitude is reached. The locking of balance-spring 1 is ensured even in the event of violent shocks, since the radial elasticity does not compensate, in this case, for the angular rigidity.

FIGS. 6 and 7 respectively show second and third embodiments of balance-spring 1 according to the invention.

Balance spring 1 illustrated in FIGS. 6 and 7 differs from the embodiment described with reference to FIGS. 1 and 2 in that it is formed of a single spiral portion 14, from the central end 11, to the peripheral end 12, which is integral with transverse segments 15' and 15"*a* and 15"*b*.

According to the first variant shown at equilibrium in FIG. 6, the length of transverse segments 15' is greater than or equal to p and less than or equal to 2 p, and said segments are secured via the middle thereof to the single spiral portion 14. The segments extend substantially radially, but in a variant, may be slightly inclined relative to the radial orientation. In such case, the inclination must be selected so that it does not prevent the return of balance-spring 1 to equilibrium, if the determined angle Ψ is exceeded. As stated above, at equilibrium, the angular shift $\theta_n$ between the transverse segments 15' respectively associated with the nth and n+1th coils 13 has a value $$\frac{\psi}{N}\cdot\frac{R_n}{R_N-R_1},$$

whereas the angular sector Φn separating them is $$360-\frac{\psi}{N}\cdot\frac{R_n}{R_N-R_1}.$$

When the rotation of balance-spring 1 according to the invention exceeds the critical value during the amplitude associated with contraction, segments 15' are aligned radially and abut against each other. Balance spring 1 is thus locked in rotation.

According to the variant shown at equilibrium in FIG. 7, balance-spring 1 has first transverse segments 15"*a* and second transverse segments 15"*b*, secured to the single spiral portion 14 via one of the ends thereof. The first transverse segments 15"*a* point towards the exterior of balance-spring 1, whereas the second transverse segments 15"*b* point towards the interior of balance-spring 1. The length l of both is greater than or equal to p/2, and less than p.

Each coil 13, with the exception of the first and last, has a transverse segment 15"*a* and a transverse segment 15"*b*. The first coil 13 from the central end 11 includes a single transverse segment 15"*a* oriented towards the exterior, whereas the last has only one 15"*b* oriented towards the interior. The transverse segments 15"*a* are aligned radially along a radius of balance-spring 1 and transverse segments 15"*b* are shifted relative to segments 15"*a* by an angle $\theta_n$. As previously, the shift $\theta_n$ between a segment 15"*a* associated with an nth coil 13 and a segment 15"*b* associated with an n+1th coil 13, has a value $$\frac{\psi}{N}\cdot\frac{R_n}{R_N-R_1}$$

and the angular sector $\Phi_n$ separating them is equal to $$360-\frac{\psi}{N}\cdot\frac{R_n}{R_N-R_1}.$$

When the rotation of balance-spring 1 according to the invention exceeds the determined value during the amplitude associated with the contraction thereof, segments 15"*a* abut against segments 15"*b*. Balance spring 1 is thus locked in rotation.

As mentioned above, there must be a minimum of two transverse segments 15*a* and 15"*a* and 15"*b*, for a braking and not locking effect on balance-spring 1. It will also be noted that, in an advantageous variant, segments 15' and 15"*a*, 15"*b* of balance-spring 1 described with reference to FIGS. 6 and 7 include fingers 16 and 17 extending angularly and intended to fit into each other to give balance-spring 1 radial rigidity in the angular locking position. This effect has already been described with reference to FIGS. 3 and 4.

Embodiments of an anti-trip balance-spring 1 intended to be locked during the vibration associated with the contraction thereof were described above. Generally, this is the positive vibration, since tripping preferably occurs during this vibration. However, it may happen that the positive vibration is associated with the extension of the balance-spring. In such case, the balance-spring is required to be locked in extension and not in contraction. FIGS. 8 and 9 illustrate a particular configuration of the balance springs 1 shown in FIGS. 6 and 7 which allow this effect.

The balance-spring 1 shown in FIG. 8 differs from the balance-spring 1 described with reference to FIG. 6, in that the transverse segments 15' are arranged for locking said spring when the amplitude of rotation thereof exceeds a critical value Ψ in extension and not in contraction. The operating principle is the same, but the rules of construction are different. In particular, the angular shift from equilibrium $\theta_n$ between two transverse segments 15' respectively associated with the n and n+1th coils 13, has a value $$\frac{\psi}{N}\cdot\frac{R_n}{R_N-R_1},$$

but the angular sector $\Phi_n$ separating them is equal to $$360+\frac{\psi}{N}\cdot\frac{R_n}{R_N-R_1}.$$

Moreover, the pitch p of a balance-spring 1 increases, when it extends radially, by a value that depends upon the vibration amplitude and the number N of coils 13. The length l of transverse segments 15' must then be such that they contact each other during the vibration associated with extension. By way of illustration, the following relation is given:

$$l \not\leq 1.6p$$

Owing to these features, each segment 15' abuts against a consecutive segment 15' when the rotation amplitude of balance-spring 1 reaches a determined angle Ψ in extension, and the rotation of balance-spring 1 is thus locked.

Likewise, the balance-spring 1 illustrated in FIG. 9 differs from the balance-spring 1 described with reference to FIG. 6 in that it includes segments 15"*a* and 15"*c* provided for locking the rotation thereof in extension and not in contraction. The transverse segments 15"*a* are aligned along a radius of balance-spring 1. Like transverse segments 15"*b*, segments 15"*c* point towards the interior of balance-spring 1, but they differ therefrom in their position relative to segments 15"*a*. As previously, the value of the shift $\theta_n$ between an nth coil 13 and a segment 15"*c* associated with an n+1th coil 13 is $$\frac{\psi}{N}\cdot\frac{R_n}{R_N-R_1},$$

but the angular segment $\Phi_n$ separating them is equal to $$360+\frac{\psi}{N}\cdot\frac{R_n}{R_N-R_1}.$$

The length l of segments 15"*a* and 15"*c* is typically equal to 0.8 p. When the rotation amplitude of balance-spring 1 reaches the determined value Ψ in extension, segments 15"*a* abut against segments 15"*c*, and the balance-spring is then locked in rotation.

Reference will now be made to FIG. 10 showing a balance-spring 1 intended to be locked in extension and in contraction when the rotation amplitude thereof reaches a determined value Ψ. Said balance-spring 1 combines the features of the balance-spring 1 shown in FIG. 7 and the balance-spring 1 shown in FIG. 9. It includes first segments 15"*a*, second segments 15"*b* and third segments 15"*c*, positioned in the manner described above in relation to each other. The transverse segments 15"*a* are thus aligned along a radius of balance-spring 1 and transverse segments 15"*b* et 15"*c* are shifted either side of segments 15"*a* by an angle $\theta_n$ equal to $$\frac{\psi}{N} \cdot \frac{R_n}{R_N - R_1}.$$

When the rotation amplitude of the balance-spring thus configured reaches determined angle Ψ, in contraction or extension, segments 15"*a* abut respectively against segments 15"*b* or 15"*c*.

Balance spring 1 according to the invention is fabricated in a material with elastic properties. Preferably, because of its discontinuous structure, silicon will be chosen to fabricate the balance-spring, using a photolithographic method well known to those skilled in the art. In a variant, a metal balance-spring could be chosen, for example nickel, or a nickel alloy and/or obtained by via a LIGA type physicochemical deposition method.

What is claimed is:

1. An anti-trip balance-spring for a timepiece escapement, intended to oscillate between two extreme positions, passing through a position of equilibrium, and including a plurality of coils, further including means for locking at least two consecutive coils when the rotation amplitude thereof from the position of equilibrium to at least one of the extreme positions reaches a determined angle Ψ, wherein said means includes at least two transverse segments integral with two consecutive coils, angularly shifted in the position of equilibrium to abut against each other when the rotation amplitude of the balance-spring from said position of equilibrium to at least one of the extreme positions, reaches a determined angle Ψ.

2. The anti-trip balance-spring according to claim 1, wherein said means includes a plurality of transverse segments integral with consecutive coils, angularly shifted in the position of equilibrium to abut against each other when the rotation amplitude of the balance-spring from said position of equilibrium to at least one of the end positions thereof reaches a determined angle Ψ.

3. The anti-trip balance-spring according to claim 1, wherein said transverse segments are oriented radially.

4. The anti-trip balance-spring according to claim 1, wherein it has a pitch p and wherein the length l of said transverse segments is comprised between p and 2p.

5. The anti-trip balance-spring according to claim 4, wherein it further includes two spiral connecting portions.

6. The anti-trip balance-spring according to claim 1, wherein it is formed of a single spiral portion integral with said transverse segments.

7. The anti-trip balance-spring according to claim 6, wherein it has a pitch p and wherein said transverse segments have a length l comprised between p and 2p, and are secured via the middle thereof to the coils.

8. The anti-trip balance-spring according to claim 6, wherein it has a pitch p and wherein said transverse segments have a length l comprised between p/2 and 2, and are secured via the end thereof to said coils.

9. The anti-trip balance-spring according to claim 8, wherein said transverse segments include first segments pointing towards the exterior of the balance-spring and second segments pointing towards the interior of the balance-spring.

10. The anti-trip balance-spring according to claim 1, wherein it is formed of silicon.

11. The timepiece escapement according to claim 1, wherein it is a detent escapement.

12. A method of fabricating an anti-trip balance-spring for a timepiece escapement, intended to oscillate between two extreme positions, passing through a position of equilibrium, and including a plurality of coils, further including means for locking at least two consecutive coils when the rotation amplitude thereof from the position of equilibrium to at least one of the extreme positions reaches a determined angle Ψ, wherein said means includes at least two transverse segments integral with two consecutive coils, angularly shifted in the position of equilibrium to abut against each other when the rotation amplitude of the balance-spring from said position of equilibrium to at least one of the extreme positions, reaches a determined angle Ψ, wherein it is formed of metal via a LIGA type method.

13. A timepiece escapement including an oscillating member provided with a balance-spring for a timepiece escapement, intended to oscillate between two extreme positions, passing through a position of equilibrium, and including a plurality of coils, further including means for locking at least two consecutive coils when the rotation amplitude thereof from the position of equilibrium to at least one of the extreme positions reaches a determined angle Ψ, wherein said means includes at least two transverse segments integral with two consecutive coils, angularly shifted in the position of equilibrium to abut against each other when the rotation amplitude of the balance-spring from said position of equilibrium to at least one of the extreme positions, reaches a determined angle Ψ.

* * * * *